United States Patent [19]

Schoonderbeek

[11] Patent Number: 4,723,698

[45] Date of Patent: Feb. 9, 1988

[54] DEVICE FOR INTRODUCING A STRIP OF MATERIAL BETWEEN THE ROLLERS OF A LOOP TAKE-UP APPARATUS

[75] Inventor: Hubertus J. Schoonderbeek, Beuningen, Netherlands

[73] Assignee: Stork Brabant B.V., An Boxmeer, Netherlands

[21] Appl. No.: 882,305

[22] Filed: Jul. 7, 1986

[30] Foreign Application Priority Data

Jul. 10, 1985 [NL] Netherlands ..... 8501984

[51] Int. Cl.[4] ..... G03B 1/56; B65H 20/24

[52] U.S. Cl. ..... 226/92; 226/119; 242/55.01

[58] Field of Search ..... 226/91, 92, 118, 119; 242/55.01

[56] References Cited

U.S. PATENT DOCUMENTS

| | | | |
|---|---|---|---|
| 2,253,076 | 8/1941 | Jones et al. | 226/92 |
| 2,376,204 | 5/1945 | Sullivan | 226/91 X |
| 3,019,855 | 2/1962 | Engle | 226/91 X |
| 3,127,079 | 3/1964 | Allander | 226/92 |

*Primary Examiner*—Stuart S. Levy
*Assistant Examiner*—Steven M. du Bois
*Attorney, Agent, or Firm*—Watson, Cole, Grindle & Watson

[57] ABSTRACT

For the introduction of a strip of material between the rollers of a loop take-up apparatus having a fixed frame that includes one or more rows of rollers and a movable jockey frame that includes one or more rows of rollers, the rows of rollers are brought into a pull-through position and the strip of material is attached to a strip pull-through device and passed through between the rows of rollers situated in the pull-through position by means of the strip pull-through device. The pull-through device comprises a chain system which preferably consists of two finite chains which in the pull-through position can be guided in grooves at both sides of the rollers. The grooves are formed by guide grooves provided in the fixed frame and the jockey frame, which guide grooves are in line with each other and together form a continuous groove when the jockey frame is in the pull-through position.

5 Claims, 4 Drawing Figures

DEVICE FOR INTRODUCING A STRIP OF MATERIAL BETWEEN THE ROLLERS OF A LOOP TAKE-UP APPARATUS

BACKGROUND OF THE INVENTION

1. Field of the Invention

The invention relates to a method for the introduction of a strip of material between the rollers of a loop take-up having a fixed frame and a movable jockey frame which are both provided with one or more rows of rollers, the rows of rollers being brought into a pull-through position and the strip of material being fed through between the rows of rollers.

2. The Prior Art

A method of this type is known.

In the known method the rows of rollers are brought into the pull-through position by the rollers of the jockey frame being passed through between the rollers of the fixed frame and, in particular, to a distance such that the rollers of the row of rollers of the jockey frame situated on the side of the fixed frame come to rest beyond the rollers of the row of rollers of the fixed frame situated on the side facing away from the jockey frame. The strip of material is then fed manually through between the rows of rollers one or more times, depending on the number of rows of rollers.

However, this manual feeding through of the strip of material has a number of drawbacks. It is not only time-consuming but several persons are required for it. In addition, the operating staff have to reach between the rows of rollers during the feeding through, which is undesirable in the context of safety.

SUMMARY OF THE INVENTION

It is the object of the present invention to eliminate the noted drawbacks.

This object is achieved by a method wherein a free end of the strip of material is attached to strip pull-through means and the strip of material is passed through between the rows of rollers situated in the pull-through position by means of the strip pull-through means.

By this means the feeding through of the strip of material can be achieved relatively rapidly and by one individual who, in addition, does not have to reach between the rows of rollers.

Preferably the free end of the strip of material is attached to a chain system which is guided in the fixed frame and the jockey frame, which is situated in the pull-through position, and the strip of material is fed through between the rows of rollers by means of the guided movement of the chain system.

By this means the strip of material can be satisfactorily fed through between the rows of rollers.

The invention also relates to a loop take-up for taking up a strip of material, having a fixed frame and a movable jockey frame which are both provided with one or more rows of rollers, it being possible for the rollers of the jockey frame to be moved between the rollers of the fixed frame, the take-up being provided with a device for introducing the strip of material between the rows of rollers which comprises strip pull-through means for feeding an end of the strip of material through between the rollers and also attaching means for attaching the end of the strip of material to the strip pull-through means, and drive means for driving the strip pull-through means.

Because no space is needed between the rows of rollers for manually feeding through the strip of material, the take-up can be constructed more compactly. In addition, the take-up needs to be accessible only on one side for the feeding through.

Preferably the strip feed-through means consist at least of a chain system which can be guided in the fixed frame and in the jockey frame.

A chain system has the advantage that it can be guided and driven easily and satisfactorily.

Expediently the chain system comprises two finite chains disposed on either side of the rollers and the ends of the two chains are linked to each other by means of a linking beam extending in parallel with the rollers.

By this means it is possible that the strip of material to be fed through can be attached over the full width, which prevents strip rupture during the feeding through.

The linking beam may be provided with clips for securing the strip of material.

The fixed frame and the jockey frame are provided with guide grooves for guiding the strip pull-through means, which grooves are disposed in a manner such that when the jockey frame is situated in the pull-through position, the grooves in the fixed frame and in the jockey frame are in line with each other and together form a continuous groove which is situated in the longitudinal direction of the roller viewed between the rows of rollers.

The invention will now be explained on the basis of an exemplary embodiment by means of the drawings.

BRIEF DESCRIPTION OF THE DRAWINGS

FIG. 3 shows the drive of the strip pull-through device according to the invention on an enlarged scale in a section along the line III—III in FIG. 2.

DETAILED DESCRIPTION OF THE PREFERRED EMBODIMENT

Figure 1:
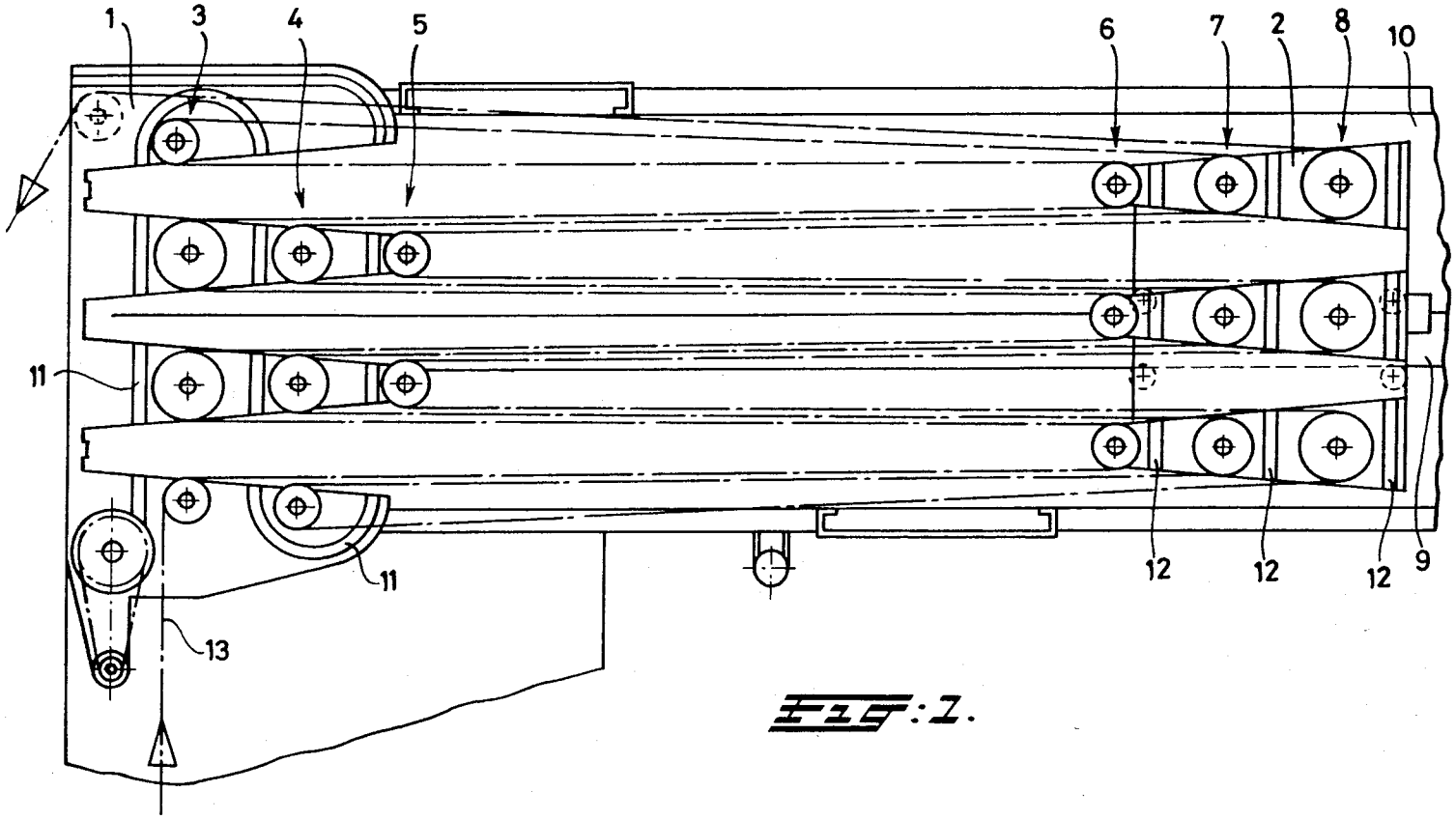
FIG. 1 shows a loop take-up according to the invention with strip of material during operation in a section perpendicular to the rollers.

The loop take-up shown in FIG. 1 consists, inter alia, of a fixed frame 1 and a movable jockey frame 2. The fixed frame 1 is provided with three rows of rollers 3, 4, 5. The jockey frame 2 is also provided with three rows of rollers 6, 7, 8. The jockey frame 2 is movable along a guide line 9 which is disposed on the frame 10 of the machine.

In the fixed frame 1 and the jockey frame 2 there are disposed on either side of the rollers, between the rows of rollers, grooves 11 and 12, respectively, the function of which will be explained below.

Over the rollers of the fixed frame 1 and the jockey frame 2 there runs a strip of material 13 which is indicated in FIG. 1 by a chain-dot line. The strip of material 13 runs alternately over a roller of the fixed frame 1 and a roller of the jockey frame 2 so that the strip of material in the take-up has the form of a number of loops situated next to each other, the number of loops being determined by the number of rollers. Differences in speed in the strip of material 13 can be absorbed by moving the jockey along the guide 9 of the take-up.

Figure 2:
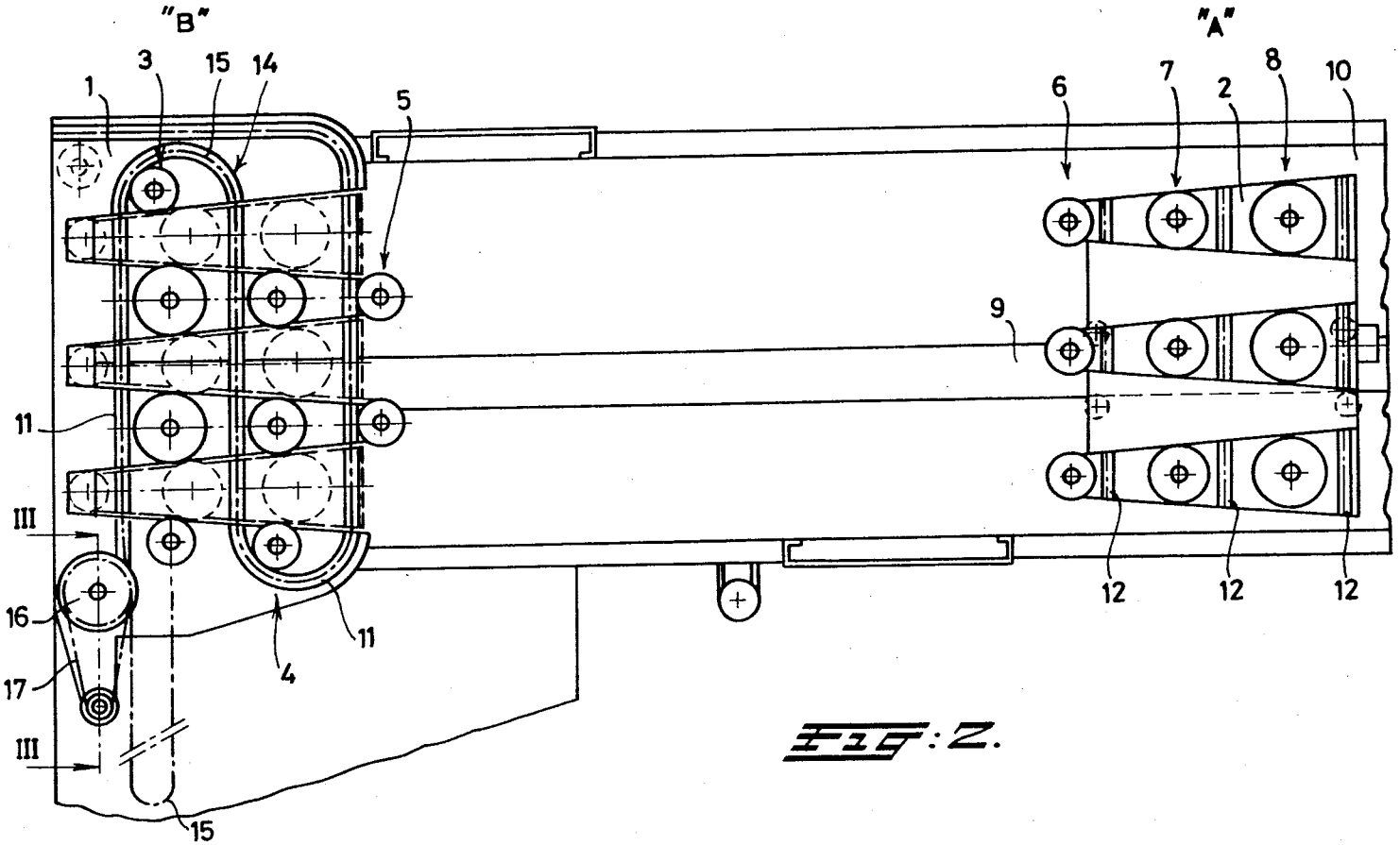
FIG. 2 shows the take-up of FIG. 1 in the operational position without strip of material and in the pull-through position.

From time to time, for example when a new strip of material is put in the machine or if the strip of material ruptures, it will be necessary for the strip of material to be fed through the take-up again. If this is the case, the jockey frame 2 is brought from an operational position, which is indicated by "A" in FIG. 2, into the pull-through position, by "A" in FIG. 2, into the pull-through position, which is indicated by "B", the rows of rollers 6, 7, 8 of the jockey frame 2 being moved between the rows of rollers 3, 4, 5 of the fixed frame 1 and, in particular, to a distance such that the rollers of the row of rollers 6 of the jockey frame 2 come to rest beyond the rollers of the row of rollers 3 of the fixed frame 1. In the pull-through position "B" the grooves 12 of the jockey frame 2 come to rest in line with the grooves 11 of the fixed frame 1 and thus form a continuous groove 14 situated between the rows of rollers on either side of the rollers.

A chain 15 can be guided through each of the two grooves 14. The chains 15 have a free end. The free ends of the chains 15 are linked to each other by means of a linking beam running parallel to the rollers.

To feed the strip of material 13 through between the rows of rollers situated in the pull-through position, a free end of the strip of material is attached to the linking beam between the free ends of the chain 15, for example by means of clips disposed on the linking beam. The chains 15 are then guided through the guide grooves situated on either side of the rollers, the end of the strip of material attached to the linking beam being fed through between the rows of rollers situated in the pull-through position.

When the strip of material 13 has been fed completely through between the rows of rollers, the end of the strip of material is detached from the chain system and the chains 15 are guided back again through the grooves 14 so that the jockey frame 2 can be brought back to an operational position "A". After the jockey frame 2 has been brought to the operational position, the strip of material 13 is situated in the correct manner in loops in the take-up.

While the strip of material 13 is being fed through between the rows of rollers by means of guiding the chain 15 through the grooves 14, the chains are driven by chain wheels 16 which are per se driven in turn, manually or mechanically, by belt 17.

The drive system is shown in more detail in FIG. 3. The two chain wheels 16 are disposed on a common shaft 18, on which a belt pulley 19 is also mounted. Over the belt pulley 19 there runs the belt 17 which, in addition, runs over the belt pulley which is mounted on a shaft 21 which can be rotated by means of a crank handle 20. FIG. 3 also shows the chains 15, and also the linking beam which links the free ends of the chains 15 to each other and which is indicated by 22.

Figure 4:
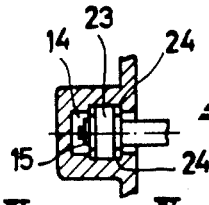
FIG. 4 is a view in section along the line IV—IV in FIG. 3.
Figure 5:
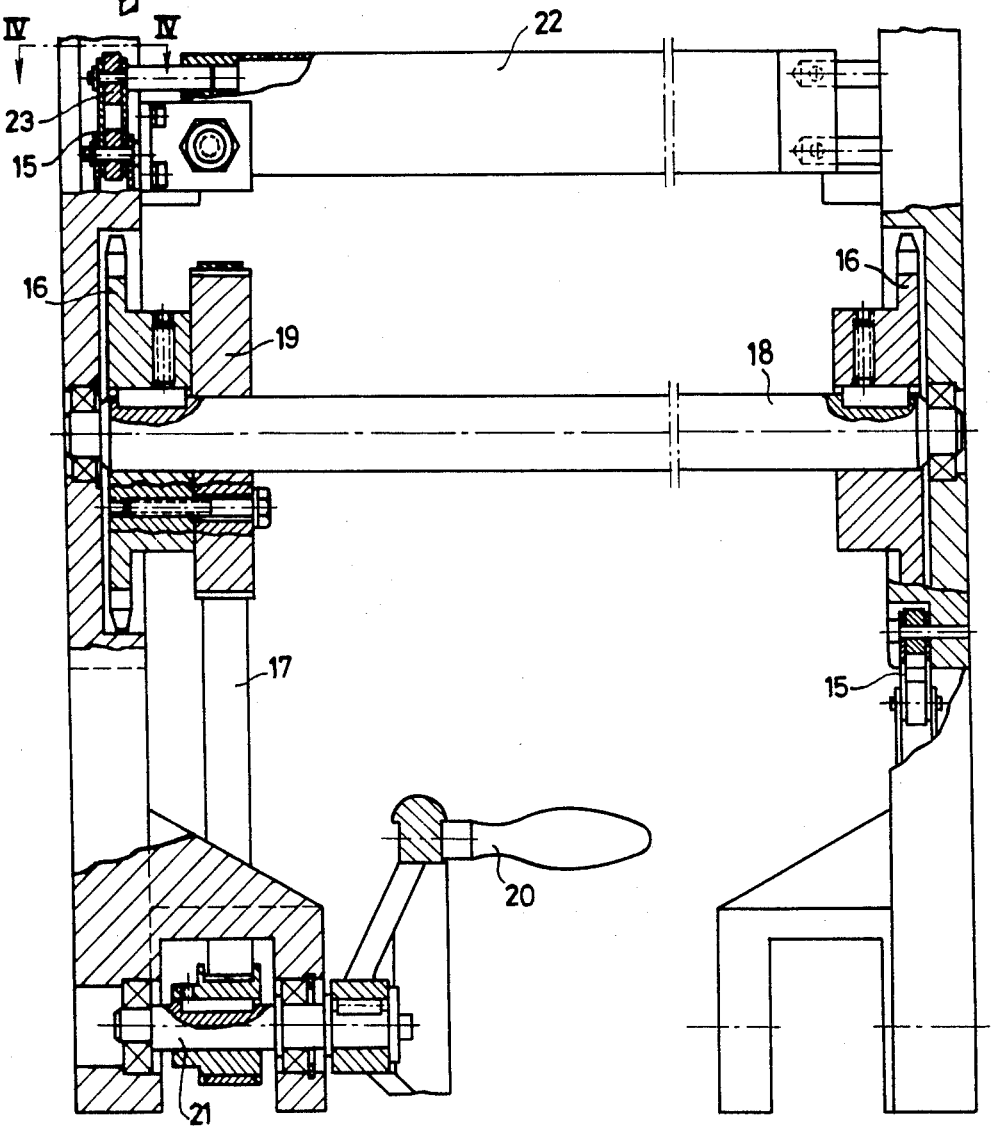

FIG. 4 indicates how a chain 15 is trapped in a guide groove 14 in the direction transverse to the longitudinal direction of the chain. At the position of the point of rotation of the links the chain 15 is provided with rollers 23 which run in shallow longitudinal grooves 24 disposed in the side walls of the guide groove 14. The rollers 23 are thereby trapped in the radial direction and also in the axial direction.

The chains 15 are used in the embodiment described as push chains, i.e., the ends of the chains 15, with the strip of material 13 attached thereto, are pushed through the guide grooves 14. However, it is also possible to feed the chains 15 first through the guide groove 14, then to attach the strip of material 13 to the chains, and finally to pull the strip of material through between the rows of rollers by means of the chains. The chains 15 then act as pull chains.

The feeding of a strip of material through between the rows of rollers by means of the chain system described has various advantages over feeding through manually:

while the strip is being fed through, it is no longer necessary to reach between the rows of rollers, which promotes safety;

the feeding through of the strip can be achieved by one individual in a short time;

the strip to be fed through can be attached over the full width, which prevents strip rupture during the feeding through;

because no space is needed between the rows of rollers for feeding through manually, the take-up can be constructed more compactly;

the take-up needs to be accessible only on one side for feeding through a strip of material.

What is claimed is:

1. A loop take-up apparatus for taking up a strip of material, said loop take-up apparatus including a fixed frame that supports one or more rows of rollers; a movable jockey frame that supports one or more rows of rollers, said jockey frame being movable to a pull-through position wherein the rollers of the jockey frame are between the rollers of the fixed frame and each of said fixed frame and said jockey frame being provided with guide grooves which are disposed in a manner such that when the jockey frame is situated in the pull-through position, the grooves in the fixed frame and in the jockey frame are in line with each other and together form a continuous groove situated between the rows of rollers on either side of the rollers; a finite strip pull-through means which is movable in said continuous groove and can feed the end of the strip of material between the rollers, the pull-through means being provided at one end with attaching means for attaching the end of the strip of material to the strip pull-through means; and drive means for driving said strip pull-through means.

2. The loop take-up apparatus of claim 1, wherein the strip pull-through means comprises a finite chain system which can be guided along the continuous groove formed by the guide grooves in the fixed frame and in the jockey frame.

3. The loop take-up apparatus of claim 2, wherein said chain system comprises two chains disposed on either side of the rollers.

4. The loop take-up apparatus of claim 3, including a linking beam which links said two chains to each other at one end, said linking beam extending in parallel with the rollers.

5. The loop take-up apparatus of claim 4, including clips on said linking beam for securing the free end of the strip of material.

* * * * *